United States Patent [19]

Parker

[11] Patent Number: 4,611,366

[45] Date of Patent: Sep. 16, 1986

[54] TREATMENT OF FIBROUS MATERIALS

[75] Inventor: Alan Parker, Bolton, England

[73] Assignee: Hollingsworth (U.K.) Ltd., Accrington, England

[21] Appl. No.: 632,764

[22] Filed: Jul. 20, 1984

[30] Foreign Application Priority Data

Jul. 25, 1983 [GB] United Kingdom ..... 8319928

[51] Int. Cl.[4] ..... D01H 5/00

[52] U.S. Cl. ..... 19/236; 19/105; 19/112; 19/205; 19/258

[58] Field of Search ..... 19/236, 258, 204, 205, 19/109, 112

[56] References Cited

U.S. PATENT DOCUMENTS

| | | | |
|---|---|---|---|
| 3,136,005 | 6/1964 | Reiterer | 19/112 X |
| 3,169,278 | 2/1965 | Aoki | 19/205 X |
| 4,135,276 | 1/1979 | Handschuch et al. | 19/105 X |
| 4,167,803 | 9/1979 | Teichmann | 19/105 X |
| 4,274,177 | 6/1981 | Grimshaw et al. | 19/105 X |
| 4,345,356 | 8/1982 | Hanschuch et al. | 19/105 X |
| 4,355,439 | 10/1982 | Estebanell | 19/105 |
| 4,430,774 | 2/1984 | Bothner | 19/258 X |
| 4,486,922 | 12/1984 | Toevank et al. | 19/105 X |
| 4,488,397 | 12/1984 | Venot . | |
| 4,512,060 | 4/1985 | Shofner | 19/205 X |

*Primary Examiner*—Louis K. Rimrodt
*Assistant Examiner*—J. Olds
*Attorney, Agent, or Firm*—Cort Flint

[57] ABSTRACT

A method and apparatus for straightening fibres in a sliver comprises subjecting the sliver to sliding frictional contact with a foraminous surface through which an airflow passes, the sliding contact having the effect of both straightening the fibres in the sliver to orientate them, and straightening the hooked ends of any fibres in the sliver, and the influence of the airflow serving to remove dust and/or trash from the sliver.

20 Claims, 4 Drawing Figures

TREATMENT OF FIBROUS MATERIALS

The present invention relates to an improved method and apparatus for treating a continuous stream of staple fibres between the carding stage and the eventual spinning stage.

Traditionally, staple fibre yarns are formed by spinning a sliver which has been subjected to various forms of pre-treatment, starting from opening the bale of the fibre, then carding, and optionally combing, and drawing with various repetitions and duplications of these operations in any desirable sequence for treatment of the particular starting staple fibre material being handled.

These various operations have different effects on the yarn.

For example, the carding operation assists in straightening the fibres to some extent but also opens the fibrous material and leaves the individual fibres with hook-like ends where the teeth of the carding cylinder have engaged the fibres.

The drawing operation has the result of pulling out these hooks in the fibres of a carded material by causing adjacent fibres to slip frictionally relative to one another.

The combing operation is principally used in order to parallelise the fibres and to remove trash, but also removes a proportion of short usable fibres which then need to be recycled. Combing is thus expensive and is reserved for quality cotton.

Although carding and combing to some extent clean the fibrous material, none of these operations mentioned above achieves any substantial cleaning and it must be borne in mind that the incoming staple fibre bale includes not only the fibrous material which is to find its way into the finished yarn, but also other vegetable matter such as trash, and dust, which must at some stage be removed. In the case of open-end spinning, the pretreated stream of fibres entering the spinner is usually opened by being subjected to the action of a beater roll which separates the individual fibres from the moving mass and additionally has the result of removing trash. However, it could be advantageous to be able to remove the trash at a much earlier stage.

It is known to subject a sliver of fibres to a cleaning operation by passage in contact with a foraminous wall through which an air current passes to extract impurities from the fibres, for example as disclosed in GB Pat. Nos. 1,175,315, 1,383,375, 749,538, 1,503,254 and 2,060,012. It is also known to extract trash from airborne fibrous material moving through a beater in open-end spinning, again by use of an air current through a foraminous wall, in this case a part of the beater housing as disclosed in GB Pat. No. 1,566,779.

It is an object of the present invention to effect this cleaning operation with greater efficiency.

According to the present invention there is provided a process for treating staple fibre material comprising contacting a sliver of the staple fibre material with a foraminous surface and generating an air current through the foraminous surface to pass through the sliver characterised by subjecting the sliver to sliding frictional contact with the surface and thereby elongating the sliver as the air current passes therethrough. The sliver of fibrous material is thus stroked by a moving foraminous surface through which an air current is passed in order to remove the trash from the moving mass and to achieve more effective straightening of the individual fibres right up to their tips, resulting from stroking of the ends of the fibres over the rims of the apertures in the foraminous surface.

A further aspect of the present invention provides apparatus for treating staple fibre material, comprising a rotatable drum having a foraminous surface, means for developing a flow of air radially through the foraminous surface of the drum, means for introducing staple fibre material into contact with the exterior of the drum, and means for conveying the sliver onwards from the drum characterised by means for holding a sliver of the staple fibre material relative to the moving foraminous surface of the drum during frictional contact between the sliver and the drum surface in such a way that the foraminous surface is in sliding contact with the thus held sliver and effects elongation of the sliver.

In order that the present invention may more readily be understood the following description is given, merely by way of example, with reference to the accompanying drawings in which.

Figure 1:
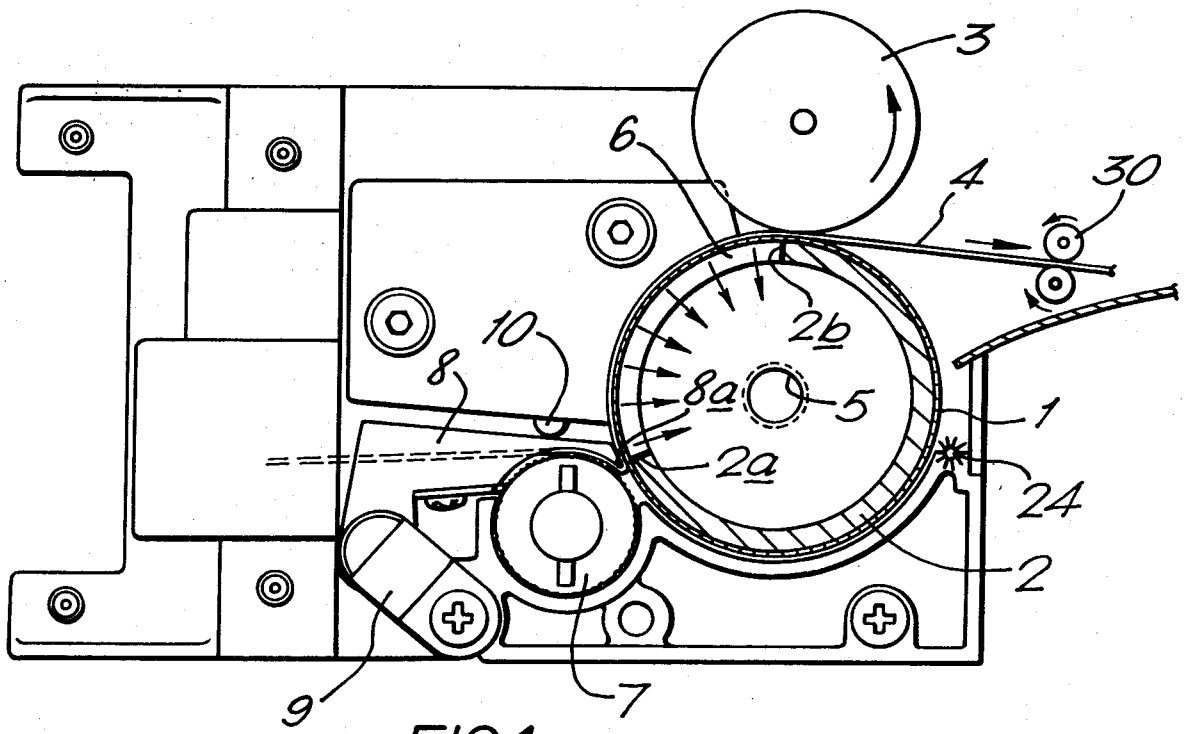
FIG. 1 is a view showing a first embodiment of pneumatic cleaning, combing and drafting apparatus in accordance with the present invention.

Turning now to FIG. 1, there can be seen a foraminous drum 1 having a masking plate 2 closely conforming to the internal cylindrical surface of the drum 1 so as to ensure that suction applied internally of the drum 1 by a suitable suction pump (not shown) is only communicated to the periphery of the suction drum 1 along a sector extending in the clockwise direction from end 2*a* of the blanking plate to end 2*b* of the blanking plate. The foraminous drum 1 is driven for clockwise rotation relative to the stationary masking plate by a drive motor and transmission (not shown).

A pressure roll 3 is spring-biased against the foraminous surface of the drum 1 so as to ensure that at that point a sliver 4 of staple fibre material is entrained for movement at the speed of the drum 1.

If desired, the pressure roll 3 may form part of the drive transmission to the drum 1 in which case the drum is allowed to rotate freely about its bearing shaft 5 and its rotation is effected by the frictional effects of the pressure roll 3 thereon.

In order to reinforce the foraminous drum 1 from within, the "open" sector extending clockwise from end 2*a* to end 2*b* of the blanking plate 2 may be reinforced by an internal plate concentric with, and preferably having the same inner and outer radii as, the blanking plate 2 and provided with radially extending apertures to communicate the internal suction radially inwardly of the reinforcing plate with the internal surface of the drum 1 radially outwardly of the reinforcing plate. Such a plate is indicated in FIG. 1 by the reference numeral 6.

A sliver of staple fibre material is applied to the surface of the foraminous drum 1 by means of a fibre feed roll 7 which co-operates with a feed pedal 8 so that the sliver 4 is guided along the feed pedal 8 and pressed into contact with the ribbed surface of the fibre feed roll 7.

For this purpose, the feed pedal 8 is mounted on a swinging support link 9 and is held in pressing contact against the sliver 4 by way of an abutment 10.

From the nip between drum 1 and pressure roll 3 the sliver 4 is advanced by means of forwarding rolls 30.

In operation of the device shown in FIG. 1, as the sliver 4 emerges from the toe 8*a* of the feed pedal 8, into the region between the ribbed periphery of the fibre feed roll 7 and the foraminous surface of the drum 1, its direction of movement changes sharply as it embarks on a clockwise motion peripherally around the axis of the drum 1 and is accelerated by virtue of the fact that the drum 1 is moving faster than the rate of delivery of the sliver 4 at the toe 8*a* of the feed pedal 8.

As the holes in the cylindrical wall of the foraminous drum 1 pass along their clockwise path starting from the feed pedal toe 8*a* where they first come in contact with the sliver 4, there is initially a velocity difference between the slowly travelling sliver 4 and the faster-moving external surface of the drum 1 with the result that these holes stroke or brush the leading ends of the fibres of the sliver 4. Thus they exert a straightening action on these leading ends which not only aligns the fibres so as to be parallel to one another, but also straightens the hooked leading ends of the fibres in the sliver 4 which has previously been subjected to a carding operation (in the manner of a drafting operation). At the same time, the draught of air through the sliver 4 helps to remove dust and/or small trash which is then conveyed away to a conventional extraction system and larger trash is held on the surface of drum 1 for subsequent collection by a trash removal brush 24.

For obvious reasons we refer to such apparatus as a cleaning-combing-drafting apparatus but this is because of the cleaning, aligning and straightening effects on the fibres rather than because of any mechanical similarity to known cleaning or combing or drafting apparatus. The apparatus may only give either an aligning or a straightening action in combination with trash removal and/or dust extraction, but preferably all of these actions are present.

The larger trash removed from the ribbon is held on the surface of the drum 1 until after the sliver 4 has passed the nip with the pressure roll 3 and has been removed from the drum 1. At that point some trash removal means may be employed to clear this larger trash from the surface of the drum 1. For example, some external pneumatic blowing action may be used to loosen the trash, or it may even be possible for the blanking plate 12 to include a portion at which a radially outwardly directed air current is passed through the drum 1 to blow the trash clear of the drum 1 (as shown at 62 in FIG. 3).

The external trash removal means may, alternatively, simply comprise a mechanical brushing means 24 with no pneumatic assistance, except perhaps a suction jet to entrain any trash loosened by the brushing action.

Although in the embodiments of the present invention described herein we show the use of radially inwardly moving suction currents of air, it will of course be understood that the dust/trash-extracting air currents could be radially outwardly directed, with some external dust and trash extraction and collection system provided. However, we prefer to have a radially inwardly directed suction flow because this does then confine the dust (and possibly small trash particles) to the interior of the drum 1 and, moreover, the suction to which the sliver 4 is subjected helps to keep it in frictional contact with the surface of the foraminous drum 1 and assists in the general fibre-straightening action.

Although we have acknowledged staple fibre handling systems in which suction rollers have been used, we emphasize that the treatment of the fibres with the apparatus of the present invention is different and improved in that in accordance with the present invention we rely on sliding contact between the sliver and the foraminous surface over at least a part of the zone of contact between the sliver and the surface, with the result that the friction between the fibres and the surface helps to align the fibres and to straighten their ends, while the simultaneous application of a pneumatic draught between the fibres helps to remove residual dust and trash therefrom. The holes in the foraminous surface in the apparatus of this invention are smaller and more closely spaced than those of a conventional suction roller in opening apparatus. No fibres should enter the holes.

Figure 2:
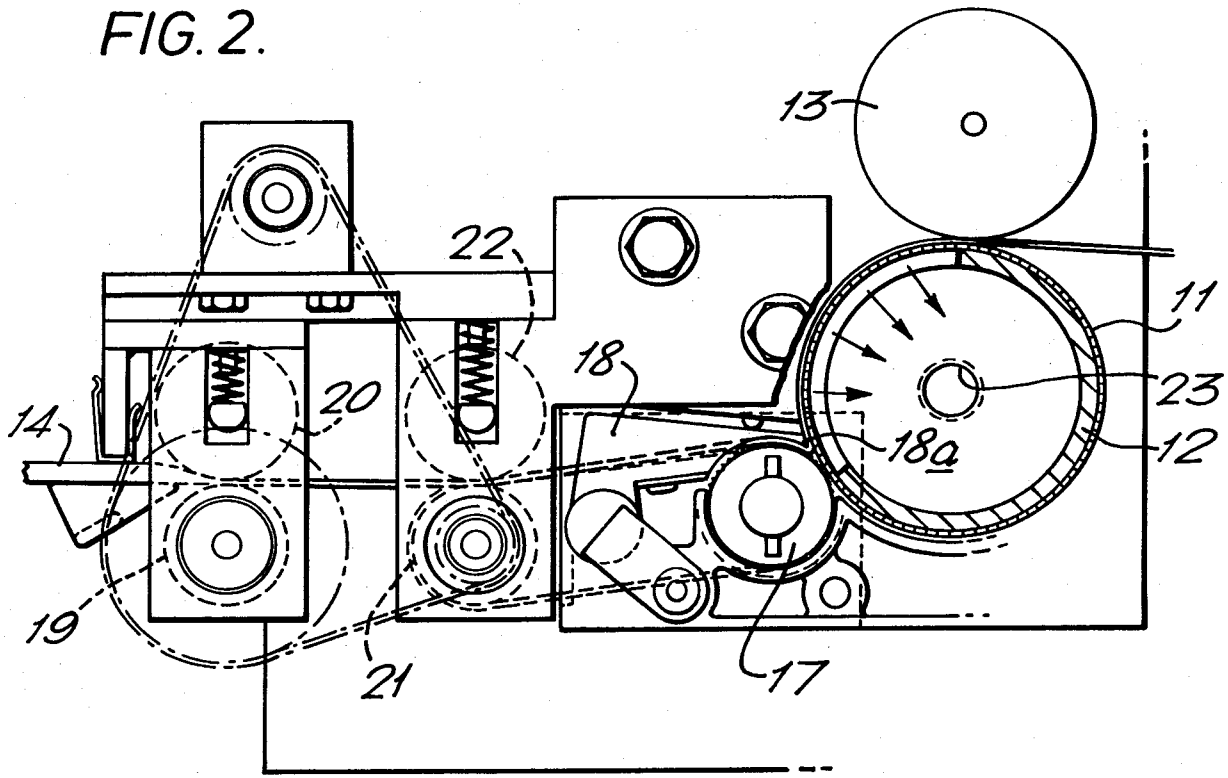
FIG. 2 is a view, similar to FIG. 1, but showing a mechanical pre-drafting operation using pre-drafting rollers.

A further embodiment of the present invention is shown in FIG. 2 where the drum, here referenced 11, has again a co-operating pressure roll 13 and a blanking plate 12, but in this embodiment the feed pedal 18 and the fibre feed roll 17 are preceded by a mechanical drafting system using a first suction roll 19 with a co-operating pressure roll 20 and a faster moving second suction roll 21 with a suction port 23 and a co-operating pressure roll 22.

The action of the conventional drafting rolls 19, 20, 21 and 22 will simply draft the sliver 14 to reduce its thickness and simultaneously to straighten the fibres, but there will of course be no cleaning action involved.

Pre-drafting the staple fibre ribbon, using the rollers 19, 20, 21 and 22 does of course serve to orientate the fibres more nearly in a direction parallel to the direction of movement of the staple fibre sliver 14 through the apparatus; in this way the action required of the foraminous drum 11 is principally one of straightening the hooked ends of fibres in the sliver 14, although to some extent there will also be further orientation of the fibres in the direction of movement of the sliver.

However, when this pre-drafted sliver 14 arrives at the feed pedal toe 18*a* it will embark on its clockwise path entrained by the rotation of the drum 11 for accelerating motion until, by the time it reaches the nip between the pressure roll 13 and the drum 11, the sliver 14 is moving at the same peripheral speed as the drum 11. During this accelerating motion, the fibres will be straightened and the tips of the leading ends of the individual fibres will have their hooks removed by the stroking action of the holes in the foraminous surface of the drum 11. Simultaneously, at least dust, and possibly also small trash, will have been extracted and sucked radially inwardly through these holes in the drum surface.

Figure 3:
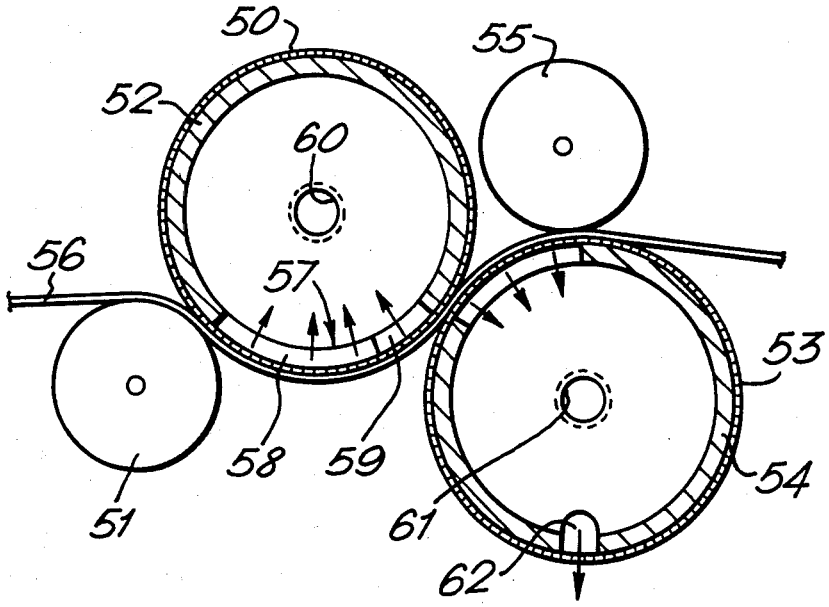
FIG. 3 is a schematic view showing an alternative system in which two suction combing and drafting rollers are employed.

FIG. 3 shows a modified embodiment of the apparatus in accordance with the present invention comprising a first foraminous drum 50 with its co-operating pressure roll 51, suction port 60 and internal blanking plate 52 to confine suction to a sector which is lowermost in FIG. 3, and a second foraminous drum 53 having a suction port 61, blanking plate 54 and a co-operating pressure roll 55.

The first foraminous drum 50 rotates in the anticlockwise direction and the second foraminous drum 53 rotates in the clockwise direction with a higher surface speed so that the sliver 56 passing from the nip between the first pressure roll 51 and first drum 50 and onwards to the nip between the second drum 53 and pressure roll 55 is gradually accelerated and subjected to a combined stroking and suction effect which will remove dust from the staple fibre sliver 56 and will stroke straight both the leading ends and the trailing ends of the fibres due to the difference in surface speed of the two drums 50 and 51.

It will of course be understood that for optimum drafting effect the maximum fibre length should be less than the length of the ribbon between the first nip at pressure roll 51 and the second nip at pressure roll 55, otherwise slip between the individual fibres will not reliably occur.

An optional characteristic of the FIG. 3 embodiment is that the suction sector is reinforced by a plate 57 having a first suction region 58 of greater air permeability and a second suction region 59 of lesser permeability, so that the staple fibre material approaching the point of inflexion where it passes from the surface of first drum 50 to the surface of the second drum 53 is subjected to lower suction in the region 59 holding it against the drum 50 and this consequently helps the greater suction to which the staple fibre ribbon is subjected at the drum 53 to transfer all of the fibres onto the drum 53. Otherwise, there might be a tendency for surface fibres in contact with the first drum 50 to remain on the drum 50.

This fibre retention by the first drum 50 may alternatively be overcome by ensuring that the suction to which the interior of the first drum 50 is subjected is uniform and less than the suction applied to the interior of the second drum 53.

As explained above, in the FIG. 3 embodiment, there are two separate but cumulative actions to which the yarn is subjected. As the fibres are picked up by the second drum 53 their leading edges will be stroked and straightened by the sliding friction with the drum 53. However, as the same fibres are accelerated off the surface of the first drum 50 their trailing ends will be simultaneously straightened. This is an action which is different from the arrangement shown in FIGS. 1 and 2 since in those two earlier-described embodiments it is mainly the leading ends of the fibres which are straightened by the stroking action, the trailing ends being to some extent straightened by the sliver elongation as a result of the slip between adjacent fibres as the sliver 4, 14 is accelerated towards the pressure roll 3, 13. Thus a generally better product should result from the FIG. 3 embodiment.

If desired, the nip between first drum 50 and first pressure roll 51 may be preceded by a mechanical pre-draft means such as the rollers 19, 20, 21 and 22 as shown in FIG. 2.

Although, as discussed above, the action to which the sliver 56 is subjected in the FIG. 3 embodiment is double-acting in that both the leading ends and the trailing ends of the fibres are straightened, there will to some extent be straightening of the trailing ends of the fibres in the FIG. 1 and FIG. 2 embodiments as they pass round the sharp point of deflection at the feed pedal toe 18*a*. Moreover, at this sharp point of deflection there will be a more effective separation of trash from the sliver due to the shear forces to which the sliver is subjected on its near reversal of direction of movement.

As indicated above in connection with the FIG. 1 embodiment, there may be means for removing external residual trash from the surfaces of the drums 11 (FIG. 2) and 50, 53 (FIG. 3). (An example of such trash removal means is shown as a blowing duct 62 on drum 53 of FIG. 3.) With all three embodiments of the present invention it is expected that there will be a very effective cleaning action on the staple fibre material.

In the FIG. 3 embodiment, it is important that the peripheral speed of the second foraminous drum 53 is greater than that of the first foraminous drum 50, otherwise the desired sliding contact between the staple fibre sliver 56 and the two drums will not be evident. Likewise, in the embodiments of FIGS. 1 and 2 it is important that the peripheral speed of the foraminous drum 1 or 11 be greater than the peripheral speed of the fibre feed roll 7 or 17, in order to achieve the same sliding frictional contact with the staple fibre sliver 4 or 14, respectively.

The importance of the sliding friction between the staple fibre sliver and the foraminous surface in the present invention is such that it may be advantageous to provide deliberate roughening of the drum surfaces so as to assist in the fibre-straightening stroking action.

Furthermore, it is possible for the drum to be formed by a process which comprises firstly the formation of holes to impart its foraminous quality and then a subsequent surface hardening treatment to reinforce the drum surface both on the external cylindrical surface and on the mouths and walls of the holes. In this way, the stroking action of these holes on the fibres will be less likely to abrade the drum material around the rims of the holes.

Figure 4:
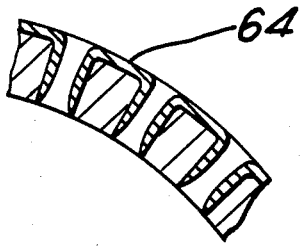
FIG. 4 shows a detail of one of the perforated rollers of the apparatus of this invention.

It may of course be advantageous for the surface hardening treatment to include the application of a hard coating, for example a ceramic coating 64 in FIG. 4, which will increase the abrasion resistance of the foraminous drums 1, 11, 50 and 53.

In order to achieve optimum pressing action at the nips with the various pressure rolls 3, 13, 51 and 55, the pressure rolls may be of resilient material and/or spring-biased into contact with the associated foraminous drum. For example, the pressure roll 3 in FIG. 1 may be formed of rubber and pressed under spring-biasing against the drum 11.

In order to effect the optimum trash and dust removal and simultaneous fibre-straightening due to the stroking of the fibres with the foraminous surface, the sizes of the holes and their mutual spacing may be varied in response to the mean fibre length or the maximum fibre length of the staple fibre material to be treated.

In one preferred configuration the individual holes in the foraminous surface may have a diameter of 0.024 inch (0.6 mm) and there may be a minimum spacing of 0.008 inch (0.2 mm) between the perimeters of adjacent holes. This will be able to eliminate substantially all of the hooked ends of fibres where these hooked ends have a hook length of 0.004 inch (0.1 mm) or more.

The expert in this art will be well aware of the fact that suction rollers used in prior art carding and opening apparatus have much larger and more widely spaced holes, and that whereas in the prior apparatus it is expected that discrete clumps of fibres being treated will be entrained on the foraminous surface without slip, that is not the intention in the present case where the holes are intended (a) to execute a stroking action on the individual fibres of a continuous sliver of fibres to straighten the hooked ends of those fibres, and (b) to allow for a cleaning air draught between the individual fibres of the sliver of staple fibre material.

The apparatus in accordance with the present invention offers a considerable improvement over conventional combing apparatus since the straightening action is exerted continuously and unidirectionally, whereas a conventional combing process employs reciprocation of the combing member and this will imply a limit on the maximum throughput rate of the ribbon of staple fibre being combed. No such maximum limit applies in the case of the present application.

Although, in all three embodiments of the apparatus illustrated in the accompanying drawings, the foraminous surface is that of a rotating drum, any other suitable moving foraminous surface such as that of a continuous belt or a rotating disc may be used to execute the desired frictional contact with the staple fibre material.

I claim:

1. A process for treating staple fibre material comprising subjecting a sliver of the staple fibre material to sliding friction contact with foraminous surface means and thereby effecting elongation of the sliver, while generating an air current through the foraminous surface means to pass through the sliver being elongated and stroked by the foraminous surface means.

2. A process according to claim 1, wherein the airflow passes first through the sliver and then through said foraminous surface means, thereby following a direction which tends to hold the sliver in contact with the foraminous surface means.

3. A process according to claim 2, and including the step of collecting dust and any small trash which passes through said foraminous surface means and also collecting any larger trash which becomes trapped on the foraminous surface means by the influence of the air currents therethrough.

4. A process according to claim 1, wherein the foraminous surface means is moving relative to a location at which the sliver is brought into contact with said foraminous surface means; and wherein at said location the sliver approaching the foraminous surface means undergoes a sharp deflection of movement whereby the leading ends of individual fibres in the sliver are subjected to the sliding frictional contact with the foraminous surface means and the trailing ends of those fibres are held by resistance to passage of the sliver past said location of sharp deflection of movement.

5. A process according to claim 1, wherein said foraminous surface means comprises first and second foraminous surfaces, and the sliver has first and second sides and is subjected alternately to sliding frictional contact on said first and second sides with said first and second foraminous surface, respectively; and wherein said first foraminous surface is so arranged and moved that it exerts a stroking action on said first side of the moving sliver in a first sense longitudinally of the sliver and said second foraminous surface is so arranged and moved that it exerts a stroking action on the second side of the sliver in a second sense longitudinally of the sliver, said first and second senses being opposed.

6. A process according to claim 1, wherein the sliver is passed between at least one said foraminous surface and a respective counterpressure member which presses the sliver against the foraminous surface.

7. A process according to claim 5, including first and second said counterpressure members, said first counterpressure member being associated with said first foraminous surface and the second counterpressure member being associated with said second foraminous surface; and wherein the path length of the sliver from the point of closest approach of the counterpressure member and first surface to the point of closest approach of the second counterpressure member and the second foraminous surface is greater than the longest fibre in said sliver.

8. A process according to claim 1, and including the step of pre-drafting the sliver before it contacts the or a said foraminous surface.

9. Apparatus for treating staple fibre material, comprising:

(a) rotatable drum means having a foraminous surface;

(b) means for developing a flow of air radially through said foraminous surface of the drum means;

(c) means for introducing a sliver into contact with the exterior of the drum means;

(d) means for holding a said sliver relative to the moving foraminous surface of the drum means in such a way that the foraminous surface is in sliding contact with the thus held sliver, and means for conveying the sliver onwards from the drum means.

10. Apparatus according to claim 9, wherein said holding means include a part of the sliver feed path to the foraminous surface of said rotatable drum means at which the sliver executes a sharp change of movement and is retarded relative to the speed of circumferential movement of the drum means.

11. Apparatus according to claim 10, wherein said holding means further include pressure roll means in rolling contact with said foraminous surface of the drum means at a position downstream of said point of sharp change of movement, whereby the sliver is pressed into sliding contact with the drum between the drum means and the pressure roll means.

12. Apparatus according to claim 9, wherein said airflow developing means comprises means for generating a radially inwardly directed suction airflow through the foraminous surface of the drum means over a first sector thereof.

13. Apparatus according to claim 9, wherein said drum means comprises first and second drums each defining foraminous surfaces and defining for the sliver a path which undergoes a point of inflection as the sliver transfers from the external surface of said first foraminous drum to the external surface of said second drum; and wherein said airflow developing means comprise first means for generating a first suction airflow radially inwardly through said first drum over a first sector of said first drum in advance of the point of inflection and second means for generating a second suction airflow radially inwardly through the second drum over a sector thereof downstream of said point of inflection.

14. Apparatus according to claim 13 and including a first pressure roll alongside the first drum so as to press a said sliver into contact with the first drum in advance of said point of inflection, and a second pressure roll adjacent the second drum so as to press a said sliver into contact with said second drum downstream of the point of inflection.

15. Apparatus according to claim 13, wherein the means for applying a suction airflow radially inwardly through said first drum include means defining a first sector of said first drum, said sector having a first air permeability value, and means defining a second sector of said first drum downstream of said first sector, said second sector having a second permeability value lower than said first value, whereby the suction flow through said first sector along the path of a said sliver towards the point of inflection is stronger than the radially inward suction airflow generated through said downstream second sector along the path of the sliver towards said point of inflection.

16. Apparatus according to claim 9, and including means for removing any residual trash held on the exterior of said rotatable drum means.

17. Apparatus according to claim 16, wherein said trash removal means include means defining a sector of said drum means spaced from said radially inward airflow through the surface, and means for generating a radially outward flow through said spaced sector of said foraminous surface of the drum means for blowing trash therefrom.

18. Apparatus according to claim 16, wherein said trash removal means includes brush means for brushing residual trash from the foraminous surface of the said drum means.

19. Apparatus according to claim 9, including a hardened coating applied both to the external cylindrical surface of said drum means and to the internal walls of the air passages through the said foraminous surface of the drum means.

20. Apparatus according to claim 9, and including means for pre-drafting the sliver being fed to the foraminous surface of said rotatable drum means.

* * * * *